US005082260A

United States Patent [19]

Dinelli

[11] Patent Number: 5,082,260

[45] Date of Patent: Jan. 21, 1992

[54] WEIGHT TRAINING APPARATUS

[76] Inventor: Michael V. Dinelli, 11104 Woodland, NE., Albuquerque, N. Mex. 87112

[21] Appl. No.: 549,269

[22] Filed: Jul. 6, 1990

[51] Int. Cl.[5] ..... A63B 21/072

[52] U.S. Cl. ..... 272/123; 272/117

[58] Field of Search ..... 272/62, 63, 117, 118, 272/122, 123, 134, 144, DIG. 4

[56] References Cited

U.S. PATENT DOCUMENTS

| | | | |
|---|---|---|---|
| 3,235,255 | 2/1966 | Leflar | 272/123 |
| 4,249,726 | 2/1981 | Faust | 272/123 |
| 4,257,590 | 3/1981 | Sullivan et al. | 272/144 X |
| 4,262,901 | 4/1981 | Faust | 272/117 |
| 4,306,715 | 12/1981 | Sutherland | 272/117 |
| 4,368,884 | 1/1983 | Colvin | 272/123 |
| 4,369,966 | 1/1983 | Silberman et al. | 272/62 |
| 4,477,074 | 10/1984 | Bushnell | 272/123 |
| 4,527,797 | 7/1985 | Slade, Jr. et al. | 272/123 |
| 4,537,395 | 8/1985 | Spinelli | 272/62 X |
| 4,561,651 | 12/1985 | Hole | 272/118 X |
| 4,635,930 | 1/1987 | Cormier | 272/123 |
| 4,648,595 | 3/1987 | Selle | 272/123 |
| 4,729,561 | 3/1988 | Desjardins | 272/117 |
| 4,757,998 | 7/1988 | Landin | 272/123 |
| 4,781,374 | 11/1988 | Lederman | 272/134 |
| 4,799,673 | 1/1989 | Selle | 272/123 |
| 4,934,693 | 6/1990 | Santoro | 272/123 |
| 4,955,604 | 9/1990 | Pogue | 272/123 |

*Primary Examiner*—Robert Bahr

*Attorney, Agent, or Firm*—Deborah A. Peacock; William A. Eklund

[57] ABSTRACT

A weight training apparatus suitable for performing most of the major weight training exercises. The apparatus includes a base which supports a pair of upper rear cross members, a pair of intermediate cross members, and a pair of adjustable safety bars. The rear cross members support a barbell at approximately shoulder height for use in connection with squats and other exercises in which the barbell is supported on the shoulders. The intermediate cross members support the barbell at a height suitable for bench presses performed with a bench, which may be positioned within the apparatus. The safety bars are adjustable in height and are positioned for use while performing bench presses as well as squats. The apparatus further includes a removable pull-up bar.

15 Claims, 3 Drawing Sheets

WEIGHT TRAINING APPARATUS

BACKGROUND OF THE INVENTION

1. Field of the Invention (Technical Field)

The invention described and claimed herein is generally related to devices for weight lifting and training. More particularly, the present invention is related to machines which are adapted for multiple weight training exercises.

2. Description of the Related Art Including Information Disclosed under 37 C.F.R. §§1.97-1.99 (Background Art)

A number of commercially available weight training systems are designed to enable multiple weight training exercises to be performed with a single apparatus, thereby minimizing the space and equipment necessary for a complete exercise program. Some of these systems are discussed below.

As one example, U.S. Pat. No. 4,369,966, issued to Silberman, et al., discloses an exercise apparatus having a folding bench and facilities for performing a number of leg, arm and torso exercises. Similarly, Desjardins U.S. Pat. No. 4,729,561, discloses a weightlifting power station having two benches which extend from a pair of back-to-back rectilinear cages having facilities for performing various common weight training exercises.

Other previously available devices are directed to only a limited number of weight training exercises. For example, Selle U.S. Pat. No. 4,799,673, discloses a bench press safety apparatus particularly designed for bench pressing exercises. Selle U.S. Pat. No. 4,648,595, also discloses a bench pressing apparatus having safety shelves. Cormier U.S. Pat. No. 4,735,930, also discloses a safety bench pressing apparatus. Slade, Jr. U.S. Pat. No. 4,527,797, discloses an apparatus particularly designed for leg press exercises. The primary disadvantage of each of these devices is that they allow for only a limited number of weight training exercises, and do not enable the majority of the major weight training exercises to be performed.

Despite the availability of various devices in the prior art, there has not been available a single yet simple apparatus which enables performance of the primary weight training exercises; namely the squats, bench presses and pull-up exercises, which together with related exercises constitute the core of a weight training program.

SUMMARY OF THE INVENTION (DISCLOSURE OF THE INVENTION)

The present invention provides a weight training apparatus which includes a base having a forward end and a rear end, and a pair of rear cross members which are spaced apart and supported by the base at the rear end of the base. The rear cross members are at a height somewhat lower than the approximate average shoulder height, so that a user can load a barbell on the cross members and subsequently shoulder the barbell while standing. The apparatus further includes a pair of intermediate cross members which are spaced apart and supported by the base at a point forward of the rear cross members. The intermediate cross members are at a height lower than the rear cross members, which height is suitable for bench press exercises using a separate bench. The apparatus further includes a pair of adjustable safety bars which are spaced apart and supported by the base at a point forward of the intermediate cross members. The safety bars are adjustable in height up to a maximum height that is lower than that of the intermediate cross members. The adjustable safety bars are positioned so that they are useful both during the performance of squats and during the performance of bench presses.

The apparatus preferably further includes a removable pull-up bar, which is inserted in a pair of tubular upright members which support the safety bars at the forward end of the base.

Accordingly, it is the object of the present invention to provide a weight training apparatus with which a user can perform a number of different weight lifting exercises.

It is also an object and purpose of the present invention to provide a compact and simple weight training apparatus that enables a user to perform substantially all of the basic weight training exercises that a weight trainer typically performs.

Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

In the Figures.

Figure 1:
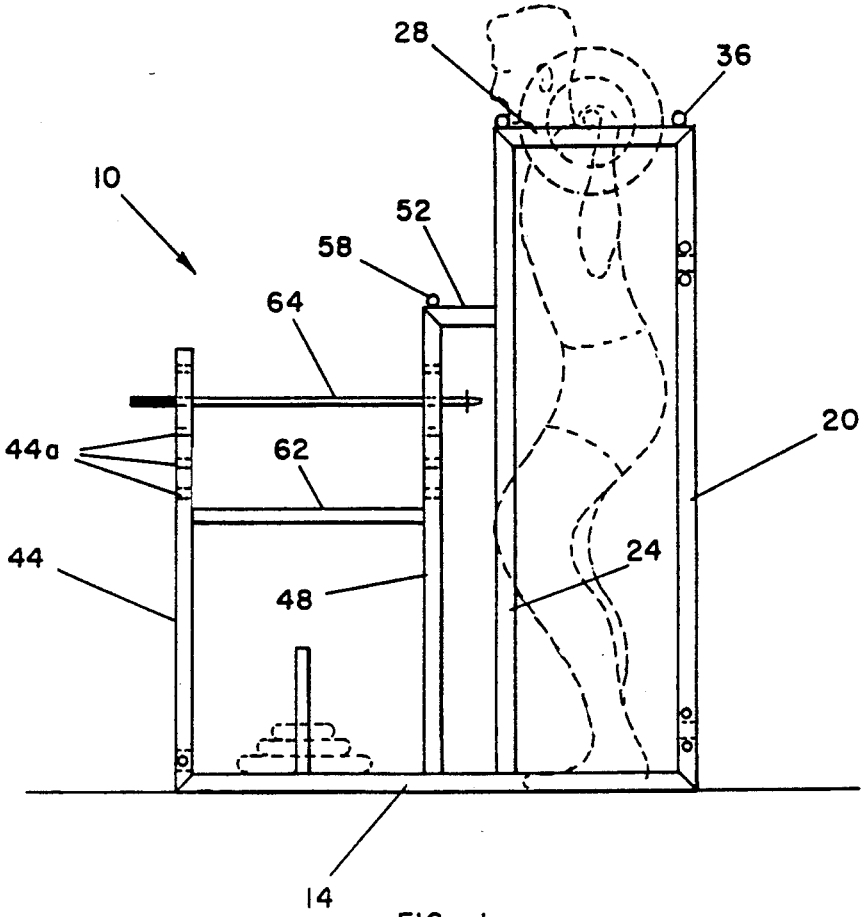
FIG. 1 is a side view of a preferred embodiment of the apparatus of the present invention, shown as it is used by a user in preparation for performing squats or calf lifts.

DETAILED DESCRIPTION OF THE PREFERRED EMBODIMENTS OF THE INVENTION (BEST MODES FOR CARRYING OUT THE INVENTION)

Referring to the Figures, the preferred weight lifting apparatus of the present invention is described below. This weight lifting apparatus includes a rectangular frame 10 having a pair of parallel, left and right base, elongate base members 12 and 14, respectively, which rest on the floor. The front ends of the base members 12 and 14 are connected by a third, front base member 16 which also rests on the floor.

A pair of left and right rear upright members 18 and 20 extend upwardly from the rear ends of the base members 12 and 14, respectively. A second pair of intermediate rear upright members 22 and 24 extend upwardly from the base members 12 and 14, respectively, at points spaced forwardly from the rear ends of the base members 12 and 14. The left upright members 18 and 22 are spanned at their upper ends by a left upper cross member 26; and the right upright members 20 and 24 are spanned at their upper ends by a right upper cross member 28. The left and right cross members 26 and 28 are preferably positioned at a height which is intended to be somewhat lower than shoulder height for the majority of adult individuals. Although the drawings do not illustrate adjusting the height of cross members 26 and 28, those skilled in the art can appreciate that adjustment of height could be accomplished in a variety of ways (e.g., upright members 20,24 and 18,22 could be telescoping or cross members 26 and 28 could angle, with one of the upright members on each side, such as 18 and 20 being higher than the other upright members 22 and 24, to provide different heights with slots or tabs to allow placement of the barbell). The left cross member 26 is provided with forward and rear barbell stops 30 and 32, respectively, and the right cross member 28 is provided with forward and rear barbell stops 34 and 36, respectively, which function to keep a barbell resting on the cross members 26 and 28 from rolling off the ends of the cross members 26 and 28. The rear upright members 18 and 20 are braced to one another by a pair of upper and lower horizontal brace members 38 and 40. respectively.

The apparatus further includes a pair of left and right forward upright support members 42 and 44, which extend upward from the front ends of the base members 12 and 14, respectively, and which are preferably upwardly opening tubular members, for the reason discussed elsewhere below. A second pair of left and right intermediate forward upright support members 46 and 48, respectively, extend upward from the base members 12 and 14 at points which are spaced rearward from the front ends of the base members 12 and 14, and which are positioned slightly forward of the intermediate rear upright members 22 and 24.

Figure 2:
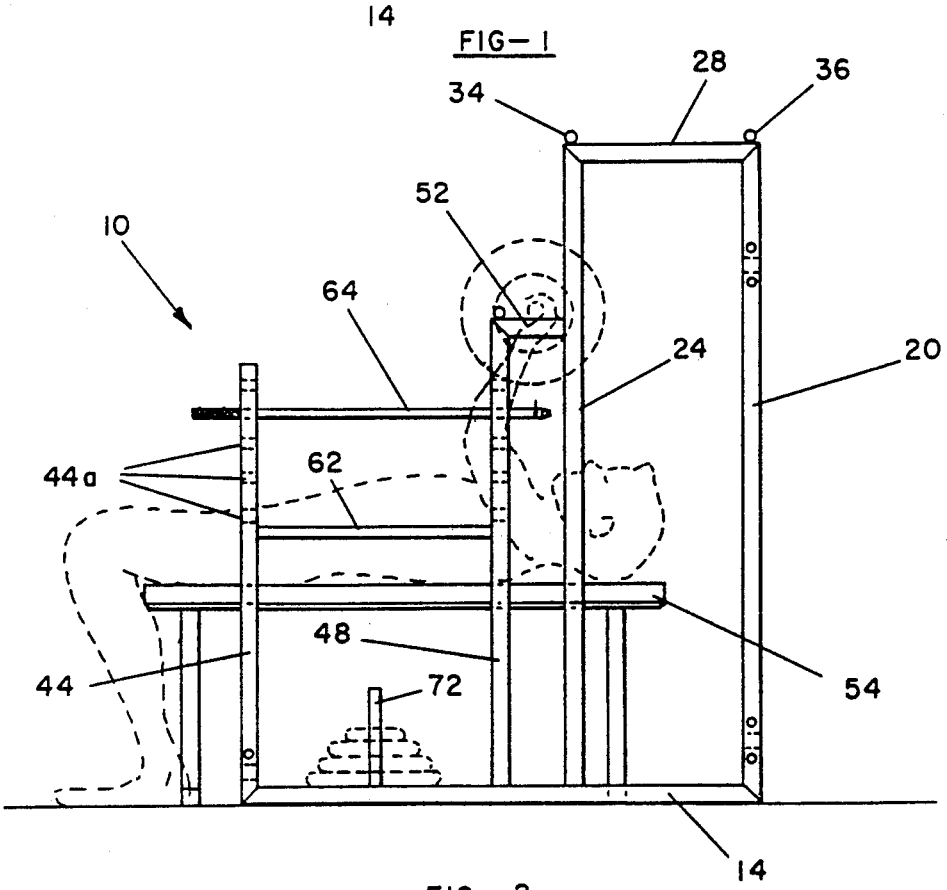
FIG. 2 is a side view of the embodiment shown in FIG. 1, as it is used in the performance of bench presses.
Figure 4:
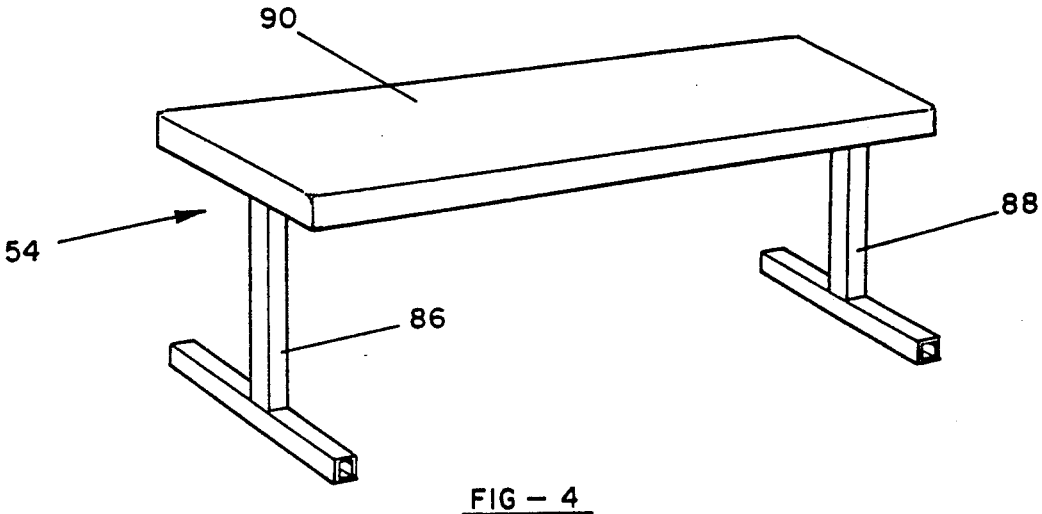
FIG. 4 is an isometric view of a bench particularly adapted for the present invention.
Figure 5:
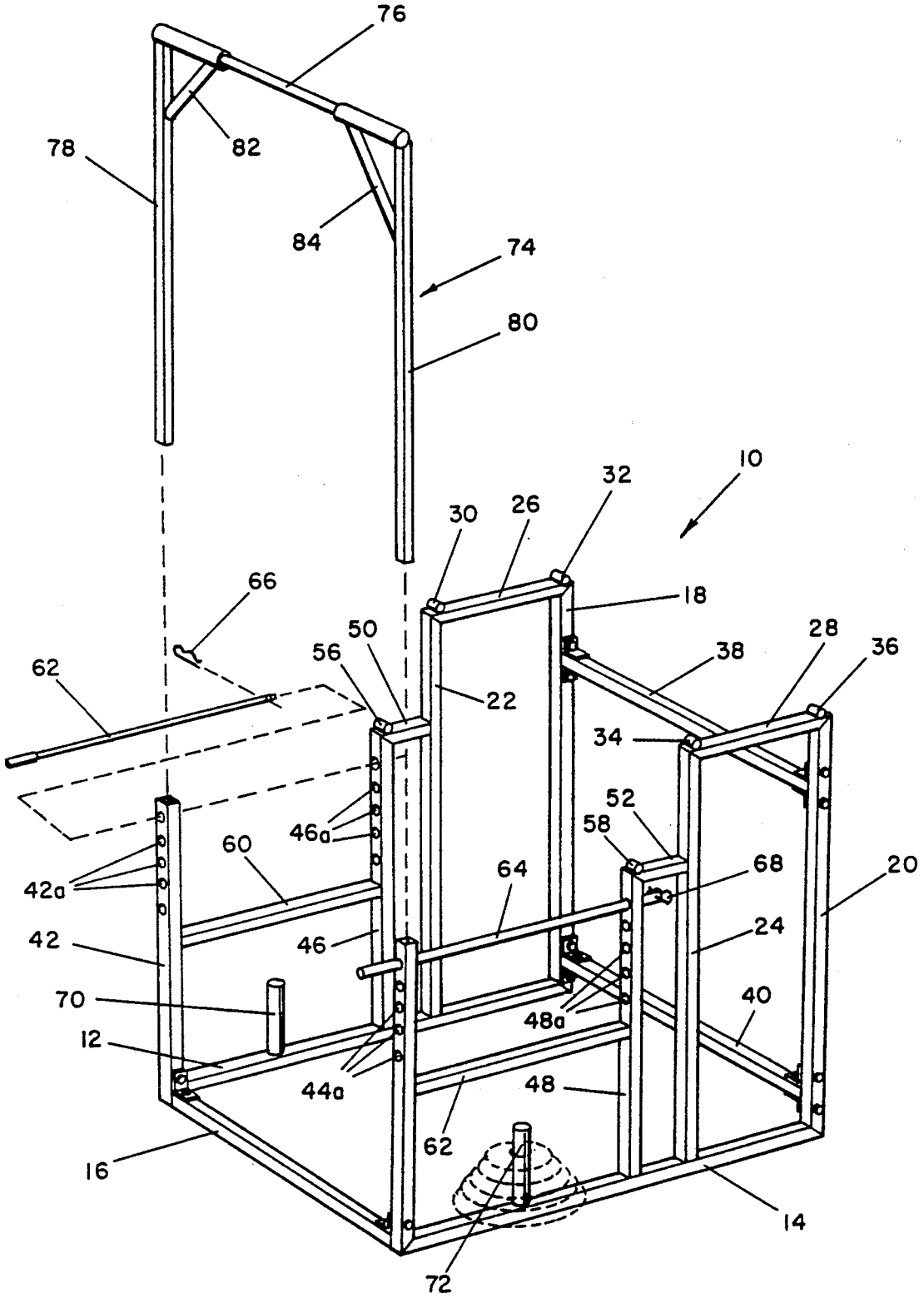
FIG. 5 is an isometric exploded view of the apparatus of FIG. 1.

The intermediate forward upright support members 46 and 48 are connected to the intermediate rear upright members 22 and 24 by a pair of left and right horizontal intermediate cross members 50 and 52, respectively. The intermediate cross members 50 and 52 are positioned at approximately torso or waist height. More particularly, they are positioned at a height at which they are appropriate for use as a barbell support for bench press exercises, when used in combination with a bench 54, such as is shown in FIGS. 2 and 4. The intermediate cross members 50 and 52 include barbell stops 56 and 58 which function to prevent a barbell from rolling off the front ends of the cross members 50 and 52.

The left forward upright member 42 is braced to the left intermediate forward upright brace member 46 by a horizontal bracing member 60. The right forward upright member 44 is likewise braced to the right intermediate forward upright member 48 by a horizontal bracing member 62. The bracing members 60 and 62 are at a height only slightly higher than that of the bench 54.

The forward upright members 42 and 44 preferably include a set of bores 42*a* and 44*a*. The intermediate forward upright members 46 and 48 likewise include a set of bores 46*a* and 48*a* which are coaxial with the bores 42*a* and 44*a*, respectively. The bores 42*a* and 46*a* receive a left safety bar 64 at any one of a plurality (e.g., five different heights, which are determined by the heights of the bores 42*a* and 46*a*. The bores 44*a* and 48*a* likewise receive a safety bar 64 at selected heights. The safety bars 62 and 64 may be secured in place by means of locking pins 66 and 68, respectively, which pass through small bores in the ends of the safety bars 62 and 64. Although bores 42*a* and 46*a* and locking pins 66 and 68 are shown in the Figures, other means of selectively adjusting the height of safety bars 62 and 64 and locking them in place may also be employed.

The apparatus may also include a pair of short barbell weight posts 70 and 72, which extend upward from the left and right base members 12 and 14 for storing weights that are not in use.

The apparatus preferably further includes a removable pull-up assembly 74, which comprises a horizontal pull-up bar 76 supported atop a pair of left and right posts 78 and 80. The posts 78 and 80 are braced with the pull-up bar 76 by diagonal bracing members 82 and 84. The upright posts 78 and 80 are insertable in the tubular forward upright members 42 and 44 to a desired height.

The bench 54 includes a pair of inverted T-shaped end legs 86 and 88 and a padded bench seat 90. It will be noted that the bench legs 86 and 88 are not connected at the floor level, so that the bench 54 can extend over the front base member 16. Although the drawing illustrates a horizontal bench, other benches, such as an incline bench, or benches with other leg or seat designs, can be used.

The apparatus can be used to perform most of the major exercises performed by weight training enthusiasts. In order to perform squats, for example, the bench 54 is removed and the barbell is set up (that is, weights are loaded onto the barbell) while it is supported on the upper cross members 26 and 28. The safety bars 62 and 64 are positioned at a height appropriate for protecting the user during squats. The user then lifts the barbell onto his shoulders, in a position as shown in FIG. 1, and then steps forward until the barbell is over the safety bars 62 and 64. Squats may be performed in this manner, with the safety bars 62 and 64 functioning in the ordinary manner of safety bars for squats. Calf raises can similarly be performed using a barbell set up while on the upper cross members 26 and 28. The rear cross members 26 and 28 will most commonly function to support a barbell so that it can be lifted onto a user's shoulders while standing, as shown in FIG. 1. They may also be used, however, to support a barbell for other purposes, for example for performing partial military presses.

To perform bench presses, the bench 54 is positioned as shown in FIG. 2, and the barbell is set up while supported on the intermediate cross members 50 and 52. The safety bars 62 and 64 are set at a height appropriate to protect the user while doing bench presses. In use, the user lifts the barbell off the intermediate cross members 50 and 52, and then shifts the barbell slightly forward to perform the bench presses over the safety bars 62 and 64.

Other exercises can be performed with the barbell supported on the intermediate cross members 50 and 52. For example, standing curls or partial dead lifts can be performed from this starting position.

Figure 3:
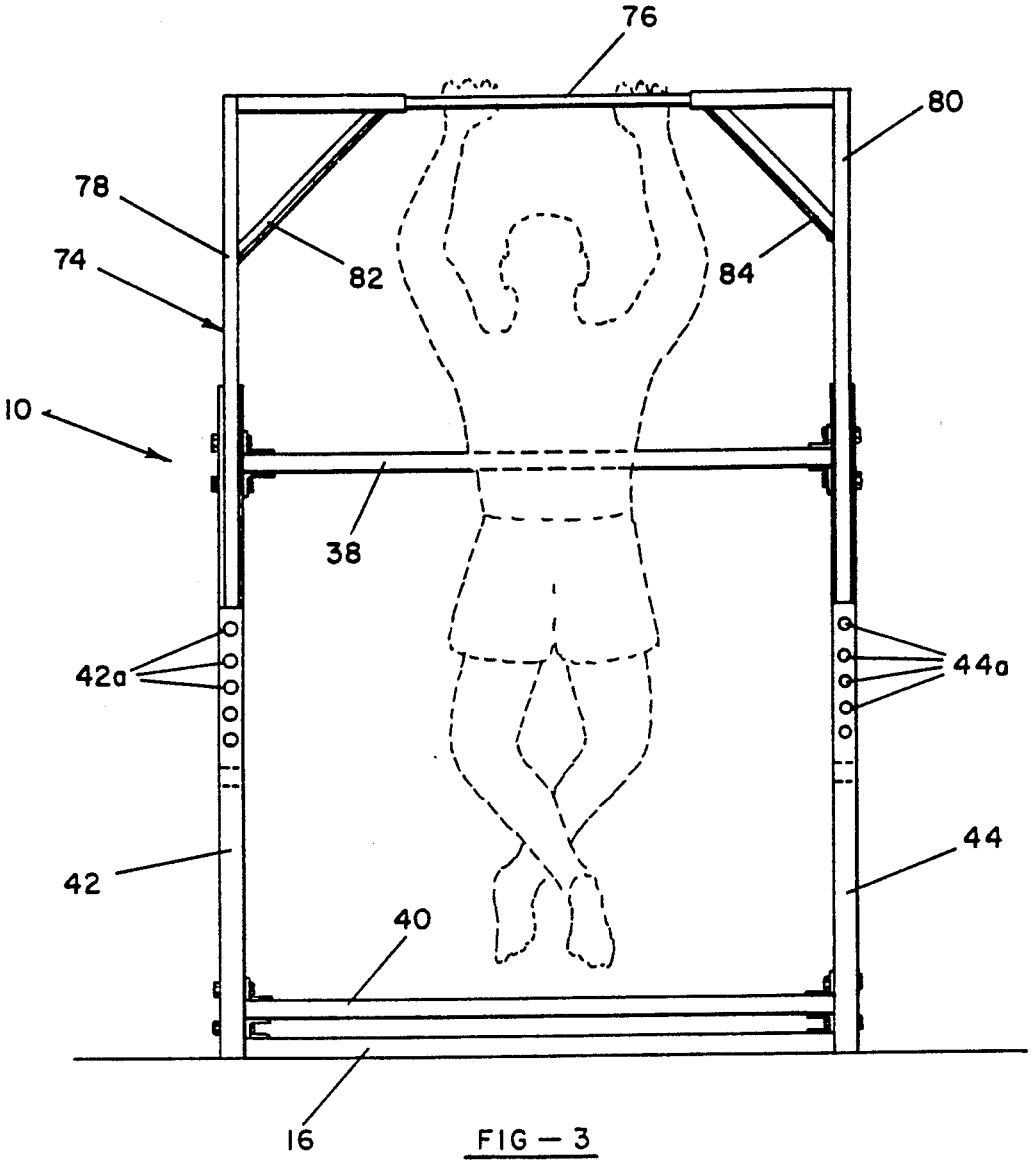
FIG. 3 is an end view of the embodiment shown in FIGS. 1 and 2, as it is used to perform chin ups.

The removable pull-up assembly 74 is used for performing pull-ups, such as, in the manner shown in FIG. 3. The pull-up assembly is preferably removable and selectively adjustable in height, such as shown in the drawings, however, it may also be fixed in position or be integral with forward support members 42 and 44.

It will be appreciated that the apparatus of the present invention enables the performance of all of the basic weight training exercises with a single, compact apparatus that is economical to construct and simple to use. Further in this regard, the present invention provides an economy of space that is particularly useful, in that it enables the performance of the major weight training exercises with an apparatus that occupies little space and provides enhanced safety.

Although the invention has been described with reference to these preferred embodiments, other embodiments can achieve the same results. Variations and modifications of the present invention will be obvious to those skilled in the art and it is intended to cover in the appended claims all such modifications and equivalents. For example, tabs could protrude from the upright support members (e.g., upper part of 22 and 24) to provide additional barbell support. Likewise, attachments, such as a cable machine or dip bar, or the like, can be temporarily or permanently attached to the present invention by any means desired by the manufacturer or user.

What is claimed is:

1. A weight training apparatus comprising:

a base having a forward end and a rear end;

a pair of spaced apart rear cross members supported by said base at said rear end of said base, said rear cross members being at a height slightly lower than the approximate average shoulder height and being supported by a pair of left and right rear upright support members and a pair of left and right intermediate rear support members;

a pair of spaced apart intermediate cross members supported by said base at a point forward of said rear cross members, said intermediate cross members being at a height lower than said rear cross members; and a pair of spaced apart adjustable safety bars supported by said base at a point forward of said intermediate cross members, said safety bars being adjustable in height up to a maximum height that is lower than said intermediate cross members.

2. The weight training apparatus defined in claim 1 wherein said intermediate cross members are supported by said intermediate rear support members and a pair of left and right intermediate forward upright support members.

3. The weight training apparatus defined in claim 2 wherein said safety bars are supported by said intermediate forward upright support members and a pair of forward support members.

4. The weight training apparatus defined in claim 3 wherein said left and right intermediate forward upright support members and said left and right forward support members comprise means for receiving said safety bars at selectively adjustable heights.

5. The weight training apparatus defined in claim 4 wherein said receiving means comprises multiple sets of coaxial bores in said left and right intermediate forward upright support members and said left and right forward support members.

6. The weight training apparatus defined in claim 4 wherein said safety bars are provided with locking means for securing said safety bars in said forward and intermediate forward upright support members.

7. The weight training apparatus defined in claim 1 wherein said base comprises a pair of parallel spaced apart elongate base members which are connected at their forward ends by a forward base member.

8. The weight training apparatus defined in claim 3 wherein said left and right forward upright support members are tubular and open upwardly, and said apparatus further comprises a removable pull-up bar, said pull-up bar including upright support posts which are removably insertable in said tubular forward upright support members.

9. The weight training apparatus defined in claim 1 further comprising a pull-up bar supported by said base.

10. The weight training apparatus defined in claim 1 wherein said apparatus further comprises weight retaining means for storing barbell weights when not in use.

11. The weight training apparatus defined in claim 10 wherein said weight retaining means comprises upright weight retaining posts extending upwardly from said base.

12. The weight training apparatus defined in claim 1 wherein said rear cross members comprise barbell stops.

13. The weight training apparatus defined in claim 1 wherein said intermediate cross members comprise barbell stops.

14. The weight training apparatus defined in claim 1 further comprising a bench.

15. The weight training apparatus defined in claim 14 wherein said bench comprises end legs with no cross member between said end legs.

* * * * *